United States Patent [19]

Nyrén et al.

[11] 4,113,555

[45] Sep. 12, 1978

[54] HARD BOARD OR MEDIUM DENSITY BOARD, PROCESS FOR PRODUCTION THEREOF AND MEANS FOR PRACTICIZING THE PROCESS

[75] Inventors: Jan O. Nyrén, Grodinge; Sören B. Nordin, Johanneshov; Leif A. Flodman, Lidingo, all of Sweden

[73] Assignee: Svenska Traforskningsinstitutet, Stockholm, Sweden

[21] Appl. No.: 761,209

[22] Filed: Jan. 21, 1977

Related U.S. Application Data

[63] Continuation-in-part of Ser. No. 519,203, Oct. 30, 1974, abandoned.

[30] Foreign Application Priority Data

Nov. 8, 1973 [SE] Sweden ..... 7315156

[51] Int. Cl.[2] ..... D21J 1/18

[52] U.S. Cl. ..... 162/127; 162/165; 162/185; 162/186; 162/188; 162/208; 162/311; 162/322

[58] Field of Search ..... 162/124, 127, 188, 165, 162/206, 185, 186, 208, 216, 225, 298, 311, 341, 322, 342, 348, 381

[56] References Cited

U.S. PATENT DOCUMENTS

| | | | |
|---|---|---|---|
| 2,970,644 | 2/1961 | Webster | 162/338 |
| 3,386,879 | 6/1968 | Yan et al. | 162/127 |
| 3,598,696 | 8/1971 | Beck | 162/298 |
| 3,802,960 | 4/1974 | Spengos et al. | 162/341 |
| 3,802,965 | 4/1974 | Arledter | 162/301 |
| 3,988,183 | 10/1976 | Senn | 156/62.2 |

*Primary Examiner*—S. Leon Bashore
*Assistant Examiner*—William F. Smith
*Attorney, Agent, or Firm*—Cushman, Darby & Cushman

[57] ABSTRACT

Hard and medium density board made of lignocellulosic fibers having a central layer with substantially higher concentration of set resin than both the outer layers of said board have as good strength properties as a corresponding board having said higher concentration of said resin throughout the thickness of the board. Said board is produced by introducing a thermosetting resin solution or a high resin content pulp into and evenly across the width of the central layer of the pulp or the wet lap to be pressed and heat treated, the pressing period being shortened as well as the press cycle. Said process can be carried out with an apparatus including a member to be inserted in the pulp slurry flow in the headbox of a board machine or in the flow on the moving continuous wire screen of the board machine comprising an element having nozzles or slits through which a thermosetting resin solution or a high resin content slurry can be brought to flow.

20 Claims, 9 Drawing Figures

Internal bonding strength of boards taken from stages 3 (triangles), 10 (squares) och 16 (circles). Normal press time without addition of phenol resin was 40 to 45 min.

HARD BOARD OR MEDIUM DENSITY BOARD, PROCESS FOR PRODUCTION THEREOF AND MEANS FOR PRACTICIZING THE PROCESS

This application is a continuation-in-part of Ser. No. 519,203, filed Oct. 30, 1974 now abandoned.

BACKGROUND OF THE INVENTION

This process relates to a hard or preferably a medium density board made of lignocellulosic fibers, a process for the production of said fiberboard and a device for practicizing the process.

It is known from the Swedish Pat. No. 318,466 corresponding to the U.S. Pat. No. 3,386,879 that addition of a thermosetting resin and a thermoplastic resin in the production of a fiberboard improves the mechanical properties of the board, above all its internal bonding strength and its dimensional stability, and that addition of large amounts of resin will make it possible to remove the wet lap (board) from the hot press at a moisture content of 10–25 %, which will shorten the press cycle and consequently increase the capacity.

From the Austrian Pat. No. 298,037 published as patent on Apr. 25, 1972 correspondingg to the Canadian Pat. No. 948,825 it is known to vary the binder content in the core layer of particle boards, said core layer being able having a binder content of the innermost core zones being higher than that of the two outer core layer zones there also being surface zones at both sides of the board.

In the Norwegian Pat. No. 62,627 there is disclosed a process for the production of pressed products of fiber containing resin masses, fiber webs or fiber containing canals or parts thereof being provided with a resin and being brought into a pressing form so that the final product after pressing and curing is eliminated showing a continuous or stepwise change from high resin zones to low resin zones.

In the products of both the cited Austrian Patent and the cited Norwegian Patent there must be at least small narrow zones between the zones having different resin content, since one zone material is laid upon another zone material according to a dry method, there being no contact between the different zones other than that between the resin.

SUMMARY OF THE INVENTION

We have now found that similar improvements of the strength properties of the fiberboards as those obtained according to the above mentioned Swedish Patent are obtained in a wallboard being a hard board having a density of 800–1100 kg/m$^3$ or a medium density board having a density of 400–800 kg/m$^3$ both made from lignocellulosic fibers, the thickness of the board being 2–25 mm and the board having two surface layers each comprising at least 10% of the board thickness and therebetween a central layer comprising 10–70 % of the board thickness and the board being prepared according to the wet process. The improvements of the strength properties are obtained with a less total amount of resin than that of the above-mentioned Swedish Patent and the above-mentioned U.S. Patent in a board of which the central layer has a mean content of 1–15 % by weight of a set resin and the surface layers having a mean content of said resin of less than 1 % by weight, the ratio of the mean resin content of said central layer and that of each of said surface layers being at least 4:1 and there being continuous changes of the resin content from the central layer to the surface layers.

The central layer is preferably between 20 and 50 % of the board thickness and the set resin is preferably a phenolformaldehyde resin. A preferred resin content of said central layer is between 2 and 6 %.

With "continuous changes of the resin content" is meant that the resin content of the central layer is steadily decreasing to that of the surface layers and there being no zone of the board having higher resin content than the central layer. Thus, between the central layer and the surface layers there is no small or narrow zone, which has a very high resin content, up to approximately 100 %. In other words, no abrupt changes of the resin content are found between the central layer and the surface layers.

The fiberboard according to the invention can be prepared according to a process comprising introducing a solution (including emulsion, dispersion and the like) of a thermosetting resin or a fiber slurry having a high content of thermosetting resin into the pulp slurry just before or after the outflow of the pulp slurry from the headbox onto the wire of a board machine. The wet lap obtained is then processed in a conventional way, as e.g. heat treated, conditioned, etc. By the process according to the invention it is achieved that the period of hot pressing is shortened, normally 10 to 40 %, when preparing fiberboards in the wet way, so that the wet laps (boards) can be withdrawn from the press at an averge moisture content of 5–25 % throughout the cross section of the board without any delaminating tendency of the board when the press is opened and the board withdrawn. The final drying of the board takes place in the following heat treatment. Thus, the shortened period of hot pressing is obtained by using substantially less resin than in the process known from the Swedish Pat. No. 318,466. The processes of the above-mentioned Austrian Patent and the above-mentioned Austrian Patent and the above-mentioned Norwegian Patent are so called "dry processes", i.e. no aqueous slurry is used, but fiber-containing particles, as e.g. wood chips, or webs or boards already prepared and treated with resin, there being a gluing of particles or other macroscopic objects together by means of the resin when pressing and subsequent processing. Thus, there is no such shortening of the period of hot pressing to be obtained.

Accordingly, the reinforcing resin according to the invention is concentrated to the central layer (middle), where it has proved to have its maximum importance and to be as advantageous as possible. It has been found, that delamination usually occurs in the central layer of the board, where the moisture content is highest. The internal bonding strength and the screw hold of the board at edge is moreover substantially dependent on the strength of the central layer. By the present invention there is obtained an overall reinforcement of fiberboards having substantially less amounts of resin than used in prior processes, in which a resin has been added to the whole stock and therefore has been more or less uniformly distributed throughout the cross section of the board.

The term "central layer" is meant to be the layer which can be as much as 70 % of the thickness of the board and in which the mathematical centre plane of the board is situated. The central layer can be displaced to one of the surfaces (main surfaces of the board) and, thus, must not be symmetric in relation to the mathematical centre plane. The surface layer being at least 10

% of the thickness of the board, must nevertheless always be situated on both sides of the central layer. The thickness of the central layer can vary, as e.g. depending on the thickness of the board, the qualities of the stock and the type of board (hard or medium density). For medium density boards having a density of 500–800 kg/m$^3$ and a thickness of 9–19 mm the thickness of the central layer is between 10 and 70 % of the thickness of the board, preferably between 10 and 50 %, e.g. between 20 and 35 %. When 70 % of the thickness of the board is central layer, i.e. having a higher content of cured resin, the central layer is about 50 % of the fibers of the board.

The resin content of the central layer can also vary between 1 and 15 %, as stated, and is preferably between 2 and 6 %. The resin content of the central layer is advantageously at least 10 times more than the resin content of the surface layer. The resin content is in this case analyzed in the centrum plane of the central layer and at the surface of the board. When an aqueous solution (including dispersion or emulsion) of the thermosetting resin is used as additive when producing the board, the resin content of this solution is 20–50 % by weight, for instance. The resin content of the pulp slurry, to be used to introduce the resin of the central layer, is normally the same as that required of the central layer of the final board.

The set resin of the wallboard according to the invention is obtained by curing or baking the wet laps obtained from the board making machine and containing thermosetting resin added during the production of the wet laps, the baking being carried out in the press in which the wet laps are pressed and by the heat treatment after pressing. This resin is preferably a phenol-formaldehyde resin, but a plurality of other binders which are thermosetting are useful and are here included in the term "thermosetting resin". Such resins are, for instance, melamine resins, acrylic plastics, resorcinol resins, urea-formaldehyde resins and proteins, such as blood albumin.

According to the invention a fiberboard is produced, which is reinforced with a thermosetting resin concentrated in the central layer of the board, e.g. by adding a solution of a thermosetting resin to the central layer in the pulp slurry on the wire at the wet end of the board machine. The supply is preferably carried out through a distributing device, which is immersed in the pulp slurry. By the expression "solution of a thermosetting resin" also suspensions, emulsions and the like of a thermosetting resin are included.

The device according to the invention is intended to be mounted at the wet end of a board making machine and comprises a transverse distributing means to an element having one or more, preferably a plurality, of nozzles or one or more slits to direct the flow of a thermosetting resin solution or a high resin content pulp slurry into the flow of an aqueous lignocellulosic fiber slurry within the headbox of said board making machine or on the moving wire screen of said board making machine. The flow from said device is directed in substantially the same direction as the flow of the aqueous lignocellulosic fiber slurry in a position where the consistency of said aqueous lignocellulosic fiber slurry is such that the slurry on its surface still shows a "water mirror", i.e. there being free water on the surface of the slurry flow. Said consistency is about 4 % or less.

The embodiments of the FIGS. 1–4 are preferably used when supplying a solution of a thermosetting resin to the fiber slurry or wet lap.

Figure 5:
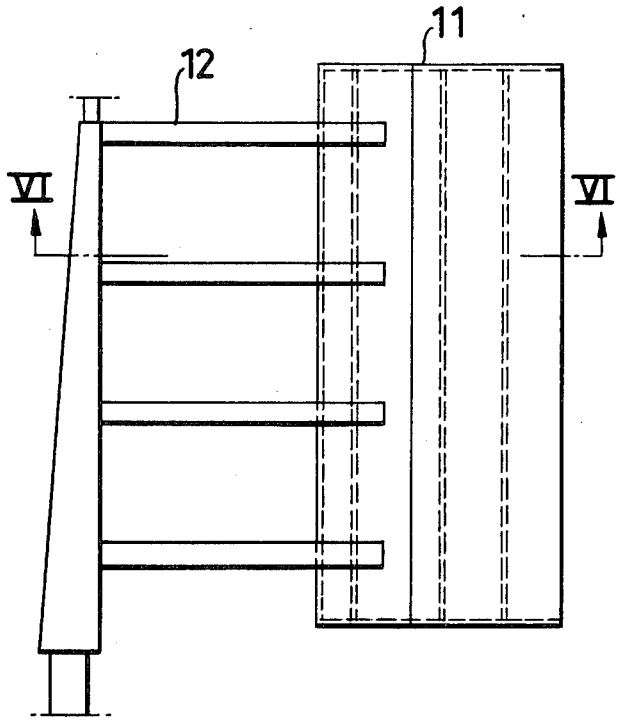
Figure 7:
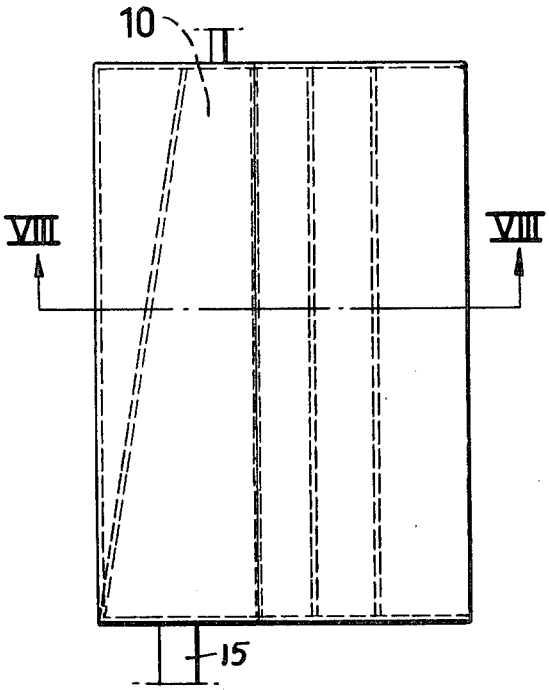

FIG. 5 and FIG. 7 are other embodiments of the apparatus according to the invention, which are especially suitable for supply of a pulp slurry with a high concentraton of a thermosetting resin to the fiber slurry or preferably the wet lap.

Figure 6:
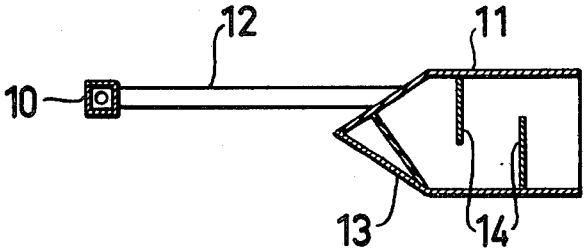
Figure 8:
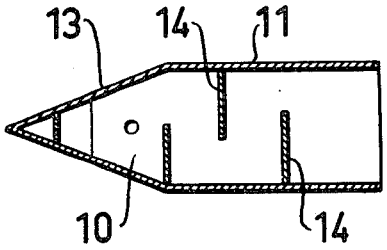

FIG. 6 and FIG. 8 are cross sections along the line VI—VI of FIG. 5 and VIII—VIII of FIG. 7, respectively.

Figure 9:
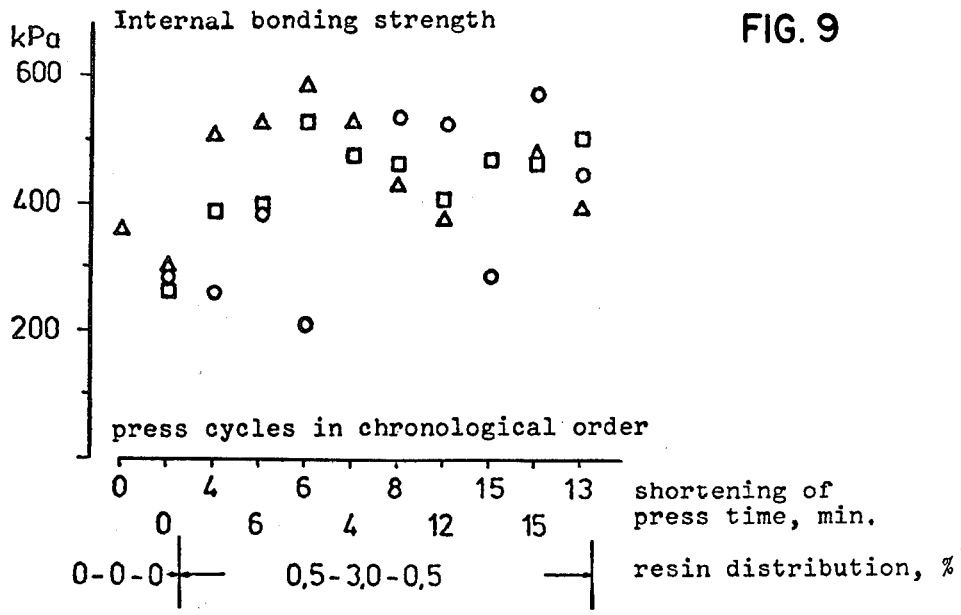

FIG. 9 shows a diagram illustrating the internal bonding strength obtained for boards according to the invention and for normal board.

Figure 1:
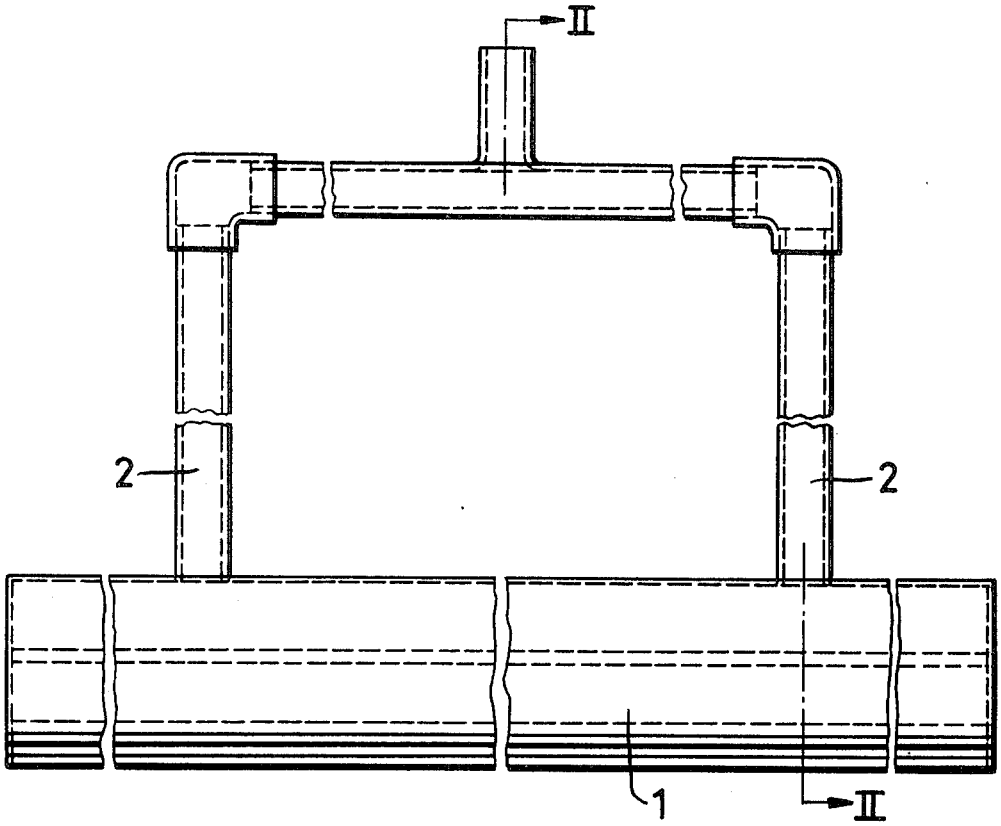
FIG. 1 shows an apparatus, which is suitable to dispose above the wire section at such a height that in operation the distribution takes place in a central layer of the pulp slurry on the wire.
Figure 2:
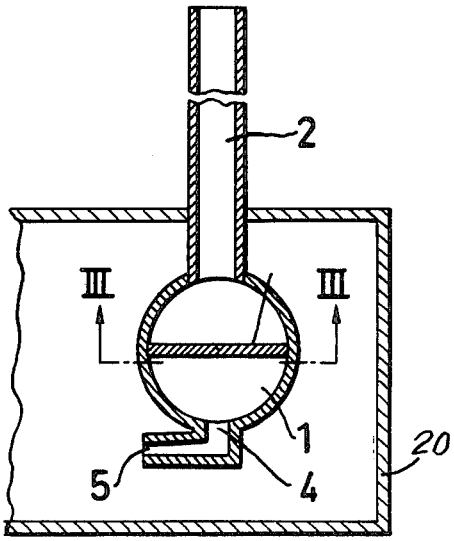
FIG. 2 is a vertical cross section along the line II—II of FIG. 1.

In FIG. 1 a device comprising a horizontal pipe 1 is shown, which is adapted to be immersed in the pulp slurry on the wire screen of the board machine. The device can also be immersed in the pulp slurry in a conventional headbox 20 as illustrated schematically in FIG. 2 wherein the arrow indicates the direction of slurry flow in the headbox 20. The device is held in position by means of holding elements not shown. The length of the pipe 1 is slightly shorter than the width of the pulp slurry on the wire screen in which the pipe 1 is immersed so that the nozzle(s) 5 is in the middle of the height of the pulp slurry on the wire screen. A solution of a thermosetting resin is supplied to the pipe 1 through pipes 2, the number of which depends on the length of the pipe 1. In FIG. 2 the pipes 1 and 2 are shown in cross section. The pipe 1 is provided with a plate 3 arranged transversely to the flow direction of the resin solution, long sides (edges) of the plate 3 are provided with holes, preferably shaped as a semi-circle. The plate 3 distributes the resin solution uniformly over the whole length of the pipe 1. The resin solution flows through a slot 4 in the pipe 1 to one or more nozzles 5. There may be only one nozzle extending like a slot along the whole length of the pipe 1 or be divided into several small slots or circular nozzles, which distribute the resin solution evenly along the length of the pipe 1 in the pulp slurry on the wire. The flow direction of the resin solution in the nozzle 5 is substantially the same as that of the pulp slurry on th wire.

Figure 3:
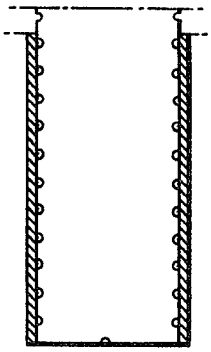
FIG. 3 is a cross section along the line III—III of FIG. 2 and shows a detail of the apparatus illustrated in FIG. 1 and FIG. 2.
Figure 4:
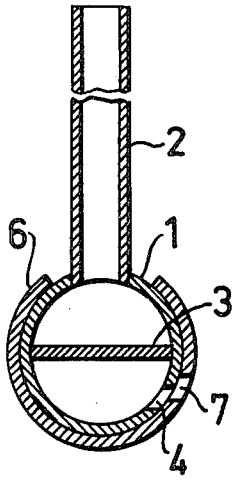
FIG. 4 is another embodiment of an apparatus to be used similar to the apparatus of FIG. 1–3.

The embodiment of the device according to the invention shown in FIG. 4 comprises a longitudinal element 1 in cross section being circular with the exception of a longitudinal slot 4 being arranged as one single slot along the length of the element 1 or being divided in several minor slots along the longitudinal element 1. Enclosing the longitudinal element 1 is a concentric longitudinal element 6 having corresponding slot(s) 7 as the slot(s) 4, the element 6 being slightly or partially turnable around the common axis of the two longitudinal elements 1 and 6, so that the slots 4 and 7 can be adjusted to a suitable width for controlling the amount of thermosetting resin solution fed to the aqueous fiber slurry. This device is also provided with a plate 3 corresponding to the plate 3 of FIG. 2. The device according to FIG. 4 is used in the same way as the device of the FIGS. 1–3 and corresponding parts are arranged analogously, so that the thermosetting resin solution flows substantially in the same direction as the pulp slurry, flowing across the longitudinal element 1. The thermosetting resin solution is fed to the device through pipe(s) 2 as in the preceding embodiment.

It is also possible to use an arrangement consisting of a series of nozzles mounted on a pipe.

In the embodiments described the solution of thermosetting resin is preferably fed to the pipe by means of a high-lift pump from a high pressure tank. These arrangements can in a simple way be mounted in existing board machines without it being necessary to alter the machine in other respects. It is also possible to use these arrangements for supply of other chemicals, e.g. fire retardant chemicals, at a desired level in the stock flow.

As it is obvious for a man of the art to arrange these devices on a board making machine, no description is made of a board making machine including headbox and moving wire screen. Furthermore, no description and no drawing show how to maintain the device in position on the board making machine, as this can be made in a plurality of ways which all are obvious for the man skilled in the art. However, it must be pointed out that the thermosetting resin solution or the high content resin fiber slurry is to be fed from the device into the pulp slurry in the same direction and in about the same velocity as the pulp slurry in the headbox or on the wire where the resin solution or the high content resin fiber slurry is introduced in about the middle of the height of the moving pulp slurry layer having such a consistency that a water level can be seen on the top of the pulp slurry layer.

If the higher content of resin in the central layer of the board is to be obtained by supplying a slurry of pulp fiber (lignocellulosic fibers) having an increased content of resin as central layer, the thermosetting resin already being precipitated on the fibers, the supply, however, preferably takes place through a separate dispensing device of a type other than that shown in FIGS. 1–4, which dispensing device is immersed in the normal stock flow on the wet end of the board making machine. In FIGS. 5 and 6 an embodiment of such a separate dispensing device is shown, which is preferably immersed in the stock flow in the normal headbox 20 of the board making machine. The pulp slurry, the stock, is supplied to this dispensing device through a transverse distributing device 10. This transverse distributing device 10 may be disposed directly in connection with said dispensing device, so that said dispensing device as well as said distributing device are immersed in the stock flow of the headbox. The dispensing device 11 shown in FIGS. 5 and 6 has a transverse distributing device 10 arranged outside the headbox and the stock is fed through pipes 12 from the distributing device to the dispensing device. In this case the rear portion 13 of the dispensing device 11 has a triangular form so that the stock flow in the headbox is not substantially disturbed. This dispensing device 11 is provided with baffles 14 to render the stock flow in this device uniform. This dispensing device and distributing device function more or less in the manner known from the headboxes.

The embodiment shown in FIGS. 7 and 8 comprises a dispensing device 11 including a transverse distributing device. This dispensing device 11 is also provided with baffles 14. This dispensing device including said transverse distributing device can be placed in the stock flow on the moving wire screen of the board making machine, the stock being supplied to the transverse distributing device 10 thereof through pipes 15, which are led through the deckle boards of the board making machine. This device 11 has also a triangular rear portion 13. It is also possible to place this dispensing device in a normal headbox of a board making machine.

These dispensing devices including transverse distributing devices according to FIGS. 5–8 can in a simple way be used with usual board making machines of Fourdrinier type with very small changes of the machine. In view of the plurality of simple ways to be used for this purpose and in view of the obviousness for the man skilled in the art to arrange these additional devices, these construction means are not shown in the drawings nor described.

The present process can also be carried out in such a way that a stock for the central layer with an increased concentration of thermosetting resin is supplied centrally in a headbox with several vertically separated discharge gates. Such headboxes are known per se from the paper making industry and references may be made to the U.S. Pat. No. 3,802,960. The stock consistency (fiber concentration) is usually between 1 and 5 % and the machine speed (moving wire screen speed) is usually between 5 and 50 meters per minute.

The stock on the wire screen is then processed in a manner which is normal and well known for making fiber board. Draining the slurry and partial dewatering to a solid content of about 25–40 % the wet lap is cut into appropriate lengths and are placed on plates normally provided with a wire screen. Usually the wet laps on the plates are conveyed to and pressed in a multiple platen press, the press platen temperatures being in the order of 180°–210° C and a pressure being as high as 1.0 MPa or more above atmospheric pressure can be used. Distance rims are normally used to control the thickness and the density of the boards obtained. The whole pressing operation is performed in a manner per se, but the pressing is interrupted when the moisture content of the board is 10–25 % which will shorten the period of pressing by 10–40 %. It is also possible to have a more normal pressing period, in which case the resin amount used can be reduced.

The board from the hot press is then heat treated or baked in a normal way to harden the board and the thermosetting resin therein. The baking is carried out for 1 or 2 hours or more at a temperature of 150° or normally 180°–210° C.

The invention is illustrated more closely in the following examples.

EXAMPLE 1.

A slurry in water was prepared at a temperature of 50° C from a plant stock without any additions, which stock was intended for the preparation of medium density boards. 0.5 % alum (aluminum sulphate) calculated on the weight of dry fibers and sulphuric acid were added to the slurry in such an amount that the pH of the slurry was brought to 4.0. The pulp suspension was moulded on a board machine to a lap with a weight of about 7.5 kg $m^2$. The wet lap formed was dewatered partially through suction boxes and wet pressed to a dry content of about 40 %. Then the wet lap was sawed to a format of 60 × 60 and pressed in a hot press provided with distance rims to a thickness of 10 mm with a closing pressure of 0.59 MPa. The press temperature was 230° C and the wet lap was pressed until the temperature in the central layer of the lap reached 200° C. The required press time was 23 minutes. This corresponds to a normally used press cycle of such a board. Immediately after the pressing the bending strength and the modulus of elasticity on bending were measured on a part of the hot board sawed in advance. The rest of the board was then heat-treated for 2 hours at 160° C. After conditioning the board obtained the following properties:

density: 750 kg/m$^3$
internal bonding strength: 0.22 MPa
bending strength: 26 MPa
modulus of elasticity on bending: 3300 MPa
bending strength directly after hot pressing and before heat-treatment: 13 MPa 2 % by weight of phenol-formaldehyde resin based on the weight of dry fiber were added before pH-adjustment to the same fiber slurry as in the previous test, after which the pH of the slurry was reduced to 4.0 with 0.5 % of alum and sulphuric acid. Also this suspension was moulded to wet laps, which were cold pressed and hot pressed in a way as described; some laps were pressed with a press time of 23 minutes and some with a press time of 11 minutes. These latter laps reached after hot pressing a dry content of 80 %. After heat-treatment for 2 hours at 160° C and conditioning the board showed the following properties.

| | Press time 11 min. | Press time 23 min. |
|---|---|---|
| thickness | 10.6 mm | 10 mm |
| density | 710 kg/m$^3$ | 750 kg/m$^3$ |
| internal bonding strength | 0.33 MPa | 0.60 MPa |
| bending strength | 23 MPa | 27 MPa |
| modulus of elasticity on bending | 2600 MPa | 3300 MPa |
| bending strength directly after hot pressing and before heat-treatment | 5.6 MPa | 13 MPa |

It is apparent from the table that the boards pressed for 11 minutes had a much lower bending strength directly after pressing, which shows that they are more easily damaged during the following treatments. Moreover, it is apparent from the table that these boards have a lower density with the same basis weight, which indicates that the board had expanded back after hot pressing.

A wet lap was moulded by the additional dispensing device described in FIG. 3 and with the transverse distributing device 10 arranged behind the ordinary headbox on a board machine of Fourdrinier type, ⅔ of the stock being supplied through the ordinary headbox and ⅓ of it through the additional dispensing device. This was so immersed in the flow of the main stock that the fiber slurry from it formed a central layer in the finished board. The fiber slurry, which was supplied through this additional dispensing device was provided with 6 % of phenolformaldehyde resin and its pH had been adjusted to 4.0 with 0.5 % of alum and sulphuric acid. Also the flow of the main stock, which was free of resin, was adjusted to a pH of 4.0. The wet laps obtained from this production thus contained 2 % of resin based on the dry content of the whole lap like the laps prepared in the previous test. However, in this case the resin was concentrated to the central one third of the lap. The wet lap was cold pressed and hot pressed in a way as described above with a hot press time of 11 minutes. After the same heat-treatment and conditioning as at the previous tests the boards obtained had the following properties:

thickness: 10 mm
density: 750 kg/m$^3$
internal bonding strength: 0.62 MPa
bending strength: 26 MPa
modulus of elasticity on bending: 3300 MPa
bending strength directly after hot pressing and before heat-treatment: 13 MPa
dry content after hot pressing: 81 %

In spite of the short press time this board showed the same strength after hot pressing as the boards obtained in the first two tests with 0 and 2 % concentration of phenol resin, the resin however being distributed in the whole board in this board with 2 % of phenol resin. The boards with the resin concentrated to the central layer showed as good handling ability after hot pressing as a conventionally pressed board. The internal bonding strength of the board after heat treatment and conditioning thereof are also very good.

EXAMPLE 2

Wet laps were manufactured in a way as described with a separate stock of central layer, to which 15 % of phenol resin, i.e. 5 % of resin based on the whole board had been added. After hot pressing for 11 minutes, heat-treatment and conditioning this board had the same properties as that with 6 % of resin in the central layer. Thus, an increase from 6 % to 15 % of resin does not influence the board properties with the phenol resin here used.

Wet laps were prepared from the same fiber slurry on a laboratory sheet form, 6 % of phenol resin being added to the central layer of the board. This time the thickness of the central layer was ¼ of the total board thickness. The laps were cold pressed to a dry content of about 40 % and then hot pressed for 11 minutes at 230° C as described. These boards showed the same high bending strength directly after hot pressing and did not show any expansion effect after pressing. After heat treatment and conditioning the board showed the following properties:

thickness: 10 mm
density: 750 kg/m$^3$
internal bonding strength: 0.45 MPa
bending strength: 26 MPa
modulus of elasticity on bending: 3300 MPa
bending strength after hot pressing and before heat-treatment: 12 MPa Boards were manufactured in indicated manner, the content of phenol resin in the central layer however being 4 % and the thickness of the central layer being ⅓ of the total board thickness. The boards were hot pressed at 230° C for 16 minutes, which provided a dry content after pressing of 90 %. The boards obtained showed the following properties:

thickness: 10 mm
density: 750 kg/m$^3$
internal bonding strength: 0.43 MPa
bending strength: 25 MPa
modulus of elasticity on bending: 3200 MPa
bending strength after hot pressing and before heat-treatment: 11 MPa

EXAMPLE 3

Wet laps were prepared in a way as described above in the form of laboratory sheets. The thickness of the central layer was one third of that of the wet lap and contained 3 % of phenol resin, i.e. the total resin content of the board was about 1 %. The board had a density of 700 kg/m$^3$.

In the following table the properties of a board prepared with 1 % of phenol resin uniformly distributed in the whole board and those of the board prepared according to the present examples and the present invention with 3 % of phenol resin in a central layer were compared. In both cases a full pressing time was used.

| | 1% of phenol resin uniformly distributed in the whole board | 3% of phenol resin in a central layer of ⅓ |
|---|---|---|
| internal bonding strength MPa | 0.38 | 0.53 |
| specific screw hold | | |
| in edge kN/m | 26 | 42 |
| in flat side kN/m | 47 | 61 |
| splitting tendency | 0.35 | 0.20 |
| water absorption % | 13.5 | 13.8 |
| thickness swelling % | 7.5 | 7.6 |

The splitting tendency in a sawed section is defined as $$\delta_z - \delta_{zz}/\delta_z$$

wherein $\delta_{zz}$ means the internal bonding strength with a wood screw screwed into the edge and $\delta_z$ means the internal bonding strength without screw. The screw, which is a wood screw of 22 mm × 6 mm, is screwed 15 mm into the edge in a hole bored in advance to 10 mm and with the diameter 2 mm. Normally the sensitivity to cracks is reported within 0.05.

The specific screw hold has been indicated in kN/m of screwing length. At the test the same bore diameter, bore depth and screwing depth were used at screwing in edge as for measuring splitting tendency. At screwing in a flat side the bore depth was ⅔ of the thickness of the board and the screw was screwed through the whole board, however, not so far that it stuck out on the underside. The extraction rate was 1 mm/min.

EXAMPLE 4

At another test a board with a density of 700 kg/m$^3$ and a total resin content of 2 % was prepared as mentioned above. When the resin content was uniformly distributed the internal bonding strength was 0.42 MPa. When all the resin was applied in a central layer, which was ⅓ of the thickness of the wet lap and thus contained 6 % of resin, the internal bonding strength increased to 0.52 MPa, in spite of the fact that the board was taken from the hot press at a dry content of about 85 % in comparison with 100 % of dry content oa the board with uniformly distributed resin.

EXAMPLE 5

In a mill test fiberboards were produced with 1.1 % of phenol resin (solids content) evenly distributed as well as fiberboards of the same total content of resin, which, however, was concentrated to a central layer. In this latter case the resin content of the central layer was about 2.1 % and in the surface layers about 0.4 %.

The tests were carried out on a board machine with a Fourdrinier wire for the preparation of wet laps having a width of 4 feet. The pulp was prepared from sawdust and had a beating degree of 30 DS (Defibrator seconds); it had a consistency of 3.5 % and a temperature of 65°–70° C at the outlet onto the wire. The machine speed (wire speed) was 7.2 m/min. The wet laps cut on the board machine and placed on pressing plates were hot-pressed in a multiple press provided with spacers. The press contained 20 stages of 4 feet × 18 feet. Pressing was carried out at a temperature of 240° C. After pressing baking was carried out for about 1.5 h at 160° C. at an even distribution in the whole lap the resin was admixed before headbox; at concentration of the resin to a central layer addition was made according to the invention. Otherwise the process was carried out in a conventional manner. The density of the resulting boards was 730 kg/m$^3$ and their thickness was 12 mm.

The stock for producing the central layer was taken from the headbox and pumped through a conduit to a transverse distributing means and a dispensing means including a slice. In the conduit alum and resin were metered and sometimes also colorant to identify the central layer. The resin was added before the pump and alum just thereafter. The pH of the stock was controlled to a value between 4.1 and 4.3. In the conduit 0.6 kg/min of phenol resin (based on dry solids) was metered. The addition of alum was 0.2–0.4 kg/min (based on dry solids). The flow through the slice has been calculated to be 1100–1200 l/min. The overflow from the transverse distributing means was recylced to a stock chest. The slice was disposed in the middle of the stock flow (between top and bottom surface) and approximately at thee end of the apron. With 1.1 % of phenol resin (based on dry solids) evenly distributed in the lap the shortest press time was 28 min. At a concentration of the resin to the central layer in the indicated way the press time could be reduced to 22–23 min.

The shortened press time did not bring about any lowering of the internal bonding strength.

It is evident from the following table below that bending strength, thickness swelling or water absorption are not deteriorated by the shortened press time, either. It is also apparent from this table that the changes of dimension in the thickness direction and along and across the machine direction (i.e. machine direction and cross machine direction, respectively) were strongly reduced in the range of 30 to 90 % of relative air humidity when the press tiime was shortened. The screw hold in the edgee and flat side and the splitting tendency were not deteriorated, either, by the concentration of the resin to the central layer or by the fact that the press time was shortened. The oil absorption according to Cobb was reduced by 20 to 30 % at a shortened press time.

Table

Total content of resin 1.1%. Thickness, density, water absorption and swelling in thickness direction are reported as average values of press platens 3, 10 and 18.

| Press time min. | Resin distribution % | Thickness mm | Density Kg/m³ | Water abs. 24 h % | Thickness swelling 24 h % | Changes of dimension of samples taken from stage 3, range 30–90% relative humidity: Thickness % | Machine direction % | Cross machine direction % |
|---|---|---|---|---|---|---|---|---|
| 28 | 1.1–1.1–1.1 | 12.0 | 720 | 20 | 10 | 6.5 | 0.24 | 0.21 |
| 28 | 0.4–2.1–0.4 | 12.0 | 740 | 20 | 10 | | | |
| 27 | " | 12.0 | 740 | 17 | 9 | 3.7 | 0.16 | 0.15 |
| 26 | " | 11.9 | 750 | 21 | 10 | | | |
| 25 | " | 12.0 | 750 | 17 | 9 | | | |
| 24 | " | 12.0 | 740 | 19 | 9 | 2.6 | 0.09 | 0.15 |
| 23 | " | 11.9 | 750 | 22 | 11 | 2.1 | 0.07 | 0.08 |
| 22 | " | 12.0 | 730 | 23 | 11 | 2.4 | 0.06 | 0.06 |

EXAMPLE 6

Tests carried out to determine the minimum press time for laps having a content of phenol resin of 0 % and 1.5 % based on dry solids. In the latter case the resin was added to the central layer, which contained 3 % of resin, the surface layers containing 0.5 % of resin. The central layer was calculated to be 40 % by weight.

The tests carried out in a mill on a board machine for production of laps of 4 feet. The pulp used had a beating degree of 18–20 DS, a consistency of 2 % and a temperature of 20°–30° C. The wire speed was 2.2 m/min. Wet laps obtained from the board machine were pressed on press plates in a hot press without spacers, the hot press, however, being provided with pressure compensating lips. The press had 18 press platens of 4 feet × 18 feet; pressing was carried out at a temperature of 215° C. After pressing baking was carried out for 3 to 4 h at 145° C. The density of the boards prepared was about 850 kg/m³ and their thickness 12 mm.

The stock of the pulp in the central layer was taken from the main pulp conduit by mmeans of a branch conduit. Addition of alum and resin was carried out in an in-line mixer of turbulence type arranged before the stock was supplied to a transverse distributing means and a dispensing means including a slice. The slice was disposed in the middle of the height of the stock flow on the wire and longitudinally about 1 m from the stock outlet from headbox. About 750 l/min were supplied through the dispensing means over the wire. The normal press time of laps without addition of phenol resin was 40–45 min. By the addition of resin according to the invention the press time could be reduced by 13 min without any board being delaminated. It was apparent from the tests that the reduced press time had not lowered the properties of the board, but the addition of phenol resin had instead improved the properties (see FIG. 9).

EXAMPLE 7

In this test the shortest press times of hard fiberboards of 6 mm thickness having the following four resin distributions were determined:

0.5 and 2.0 % of phenol resin (based on dry solids) evenly distributed in the laps, and 0.5 % of phenol resin (based on dry solids) in the surface layers and 2.4 and 5.0 % in the central layer. The total resin content based on the whole lap was 1.3 and 2.0 %, respectively.

The tests were carried out in a mill on a board machine having a working width of 4 feet. The raw material was 50 % of unbarked slab wood, 40 % of roundwood and the rest sawdust and knot pulp from a paper mill. The pulp had a beating degree of about 20 DS, a consistency of 2.5–2.7 % and a temperature of about 40° C. The wire speed was 12 m/min. Pressing was carried out in a hot press with pressure compensating lips under each third press platen. The press had 18 press platens of 4 feet × 18 feet. The press temperature was 215°–220° C. After pressing heat treatment (baking) was carried out for 6.5 h at 165° C and conditioning for 10 h. The density of the resulting boards was 900–950 kg/m³ and their thickness 6 mm.

The stock of a central layer was taken from the main pulp conduit through a branch pipe in the same way as in the previous examples, in addition to which alum and resin were added in the same way. pH was adjusted to 4.0 ± 0.3. About 1100 l/min of stock was introduced through the dispensing means. The wet laps had a dry solids content of about 30 % after the board machine. 4 g/m² of wax were sprayed on their surface.

The shortest press time of laps with 0.5 and 2.0 % of phenol resin (based on dry solids) evenly distributed was 10.0 min. With 0.5 % of resin in the surface layers and about 2.4 % in the central layer, which is 1.3 % based on the whole lap, the press time could be reduced to 8.5 min. At a resin content of 5.2 % in the central layer, which is 2.0 % at an even distribution, the press time could be shortened to 7.5 min. A shortening of the press time had the effect that the thickness of the laps increased after hot pressing. However, after baking all boards produced had about the same thickness.

The tests made show that the properties of the boards did not deteriorate with a shortened press time. This is apparent from the following table, where the internal bonding strength and the bending strength, the modulus of elasticity on bending, water absorption and thickness swelling are shown as average values of samples from the press platens 1, 3, 7 and 15, calculated from the top of the press. The oil absorption of the boards tested according to Cobb was independent of the press time but was reduced by about 10 % when the resin content in the surface layers increased from 0.5 to 2 %.

Table

Tests with hardboards of 6 mm thickness.
Average values of samples from press platens 4, 12, 16 and 18, numbered from below.

| Press time min. | Total resin content % | Resin distribution % | Thickness mm | Density kg/m³ | Internal bonding strength kPa | Bending strength MPa | Modulus of elasticity in bending GPa | Water absorption 24 h % | Thickness swelling 24 h % |
|---|---|---|---|---|---|---|---|---|---|
| 13 | 0.5 | 0.5–0.5–0.5 | 5.8 | 910 | 390 | 22 | 2.8 | 21 | 13 |
| 11.3 | | | 5.8 | 940 | 460 | 26 | 3.3 | 15 | 11 |
| 11.0 | | | 5.8 | 960 | 600 | 31 | 3.5 | 17 | 11 |
| 10.1 | | | 5.8 | 940 | 610 | 31 | 3.5 | 19 | 12 |
| 10.0 | | | 5.8 | 940 | 490 | 25 | 3.1 | 18 | 12 |
| 9.9 | 1.3 | 0.5–2.4–0.5 | 5.7 | 960 | 700 | 31 | 3.6 | 15 | 11 |
| 8.6 | | | 5.7 | 950 | 820 | 32 | 3.7 | 15 | 11 |
| 8.2 | | | 5.8 | 920 | 530 | 28 | 3.3 | 16 | 11 |
| 12.0 | 2.0 | 2.0–2.0–2.0 | 5.9 | 930 | 480 | 31 | 3.7 | 14 | 10 |
| 11.0 | | | 5.8 | 940 | 560 | 32 | 3.7 | 14 | 10 |
| 10.3 | 2.0 | 0.5–5.2–0.5 | 5.7 | 920 | 410 | 26 | 3.2 | 16 | 11 |
| 9.0 | | | 5.6 | 950 | 430 | 28 | 3.3 | 17 | 11 |
| 7.9 | | | 5.6 | 950 | 510 | 28 | 3.3 | 15 | 10 |
| 7.5 | | | 5.9 | 950 | 600 | 29 | 3.3 | 15 | 10 |

What we claim is:

1. In a wallboard selected from the group consisting of hardboard having a density of 800–1100 kg/m³ and medium density board having a density of 400–800 kg/m³ made from lignocellulosic fibers, the thickness of the board being 2-25 mm and the board having two surface layers each comprising at least 10% of the board thickness and therebetween a central layer comprising 10–70% of the board thickness and prepared according to the wet process and being reinforced with a set resin, the improvement comprising: the central layer having a mean content of 1–15% by weight of said resin, based on the central layer, distributed evenly throughout said layer and the surface layers having a mean content of said resin of less than 1% by weight, the ratio of the mean resin content of said central layer and that of each of said surface layers being at least 4:1 and the resin content of the central layer steadily decreasing to that of the surface layers and there being no zone of the board having higher resin content than the central layer.

2. Wallboard according to claim 1, wherein the central layer comprises between 20 and 50% of the board thickness.

3. Wallboard according to claim 2, wherein said resin is a phenol-formaldehyde resin.

4. Wallboard according to claim 1, wherein said resin content of said central layer is between 2 and 6%.

5. In a process for the preparation of building board selected from the group consisting of hard and medium density board made from lignocellulosic fibers, wherein an aqueous suspension of said lignocellulosic fibers having a consistency in the range of 1.0–4.0% is fed onto a moving wire screen of Fourdrinier type in a board machine for dewatering, whereafter the wet lap dewatered on said moving wire screen is subjected to the normal steps of pressing and baking, the improvement comprising introducing evenly across the width of the suspension an aqueous solution of a thermosetting resin into a central layer of said lignocellulosic fiber suspension having a consistency in said range near the headbox of said board machine such that the resin content of the central layer steadily decreases to that of the surface layers and such that there is no zone of the board having higher resin content than the central layer.

6. A process as in claim 5 wherein the aqueous solution of a thermosetting resin is introduced into the suspension where there is a water level on the top of the suspension.

7. The process of claim 5, wherein said resin solution is introduced into the aqueous suspension of said lignocellulosic fibers within the headbox of the board machine.

8. The process of claim 5, wherein said resin solution is introduced into said aqueous suspension of said lignocellulosic fibers on the wire.

9. The process of claim 5, wherein the thermosetting resin content of said solution is 20–50%.

10. a process for the preparation of building board selected from the group consisting of hard and medium density board made from lignocellulosic fibers, wherein an aqueous suspension of said lignocellulosic fibers having a consistency in the range of 1.0–4.0% is fed onto a moving wire screen of Fourdrinier type in a board machine for dewatering, whereafter the wet lap dewatered on said moving wire screen is subjected to the normal steps of pressing and heat treatment, the improvement comprising introducing evenly across the width of the suspension a slurry of lignocellulosic fibers having a content of 1–15% by weight of a thermosetting resin into a central layer of said lignocellulosic fiber suspension having a consistency in said range near the headbox of said board machine such that the resin content of the central layer steadily decreases to that of the surface layers and such that there is no zone of the board having higher resin content than the central layer.

11. The process of claim 10, wherein said lignocellulosic fiber slurry is introduced into the aqueous suspension of said lignocellulosic fibers within the headbox of the board machine.

12. The process of claim 10, wherein the lignocellulosic fiber slurry is introduced into said aqueous suspension of said lignocellulosic fibers on the wire, said suspension having said consistency range of 1.0–4.0%.

13. A process as in claim 10 wherein the slurry of fibers containing the resin is introduced into the suspension where there is a water level on top of the suspension.

14. In a board making machine wherein a pulp slurry flow of a consistency of less than 4% is fed on to a moving wire screen, the improvement comprising a device for introducing a thermosetting resin solution into the pulp slurry flow in the direction of the slurry flow, said device comprising a straight pipe having the ends closed, the pipe being disposed in the slurry and transversely to the direction of the slurry flow and being provided with an internal partition plate provided with holes for distributing solution admitted to the pipe uniformly along the pipe, nozzles connected to the pipe and directed in the pulp flow direction, inlet means for feeding solution to the portion of the pipe other than that connected to the nozzles, and means for holding the device in position in the pulp flow.

15. The device of claim 14, wherein the inlet means comprises at least one pipe connected to the upper part of the horizontal pipe.

16. The device of claim 14, wherein the nozzles are combined to form at least one slot.

17. In a board making machine wherein a pulp slurry flow of a consistency of less than 4% is fed on to a moving wire screen, the improvement comprising a device for introducing a thermosetting resin solution into the pulp slurry in the direction of the slurry flow, said device comprising hollow, elongated means having circular cross section said elongated means being disposed in the slurry flow and transversely to the direction of slurry flow and being provided with a partition wall which divides the hollow means into two chambers and which is provided with holes to uniformly distribute solution flowing from one chamber to the other, this latter chamber being provided with at least one slot in alignment along the elongated means to admit solution into a central layer of said pulp slurry flow in the same direction as this flow, the elongated means being surrounded by a matching turnable envelope having at least one slot matching said at least one slot in the elongated hollow means so that the flow through both said at least one slot can be controlled and means for feeding said elongated hollow means with solution and means for fastening the device in position in the pulp slurry on the board making machine.

18. The device of claim 17, wherein the device is positioned with said at least one slot in a central layer of the pulp flow on the board making machine.

19. The device of claim 18, wherein the device is positioned in the headbox of the board making machine.

20. The device of claim 18, wherein the device is positioned in the pulp slurry flow on a moving wire screen of the board making machine.

* * * * *